US007225734B2

(12) United States Patent
Schanz

(10) Patent No.: US 7,225,734 B2
(45) Date of Patent: Jun. 5, 2007

(54) DEVICE AND METHOD FOR POSITIONING A SUBSTRATE TO BE PRINTED

(75) Inventor: Karl Schanz, Heilbronn (DE)

(73) Assignee: Asys Automatisierungssysteme GmbH, Dornstadt (DE)

( * ) Notice: Subject to any disclaimer, the term of this patent is extended or adjusted under 35 U.S.C. 154(b) by 98 days.

(21) Appl. No.: 10/515,166

(22) PCT Filed: May 16, 2003

(86) PCT No.: PCT/EP03/05200

§ 371 (c)(1),
(2), (4) Date: Nov. 17, 2004

(87) PCT Pub. No.: WO03/097357

PCT Pub. Date: Nov. 27, 2003

(65) Prior Publication Data

US 2005/0166772 A1 Aug. 4, 2005

(30) Foreign Application Priority Data

May 17, 2002 (DE) ..... 102 22 119

(51) Int. Cl.
*B41M 1/12* (2006.01)

(52) U.S. Cl. ..... 101/129; 101/127

(58) Field of Classification Search ..... 101/127.1, 101/128, 126, 127, 129, 114
See application file for complete search history.

(56) References Cited

U.S. PATENT DOCUMENTS

| | | | | |
|---|---|---|---|---|
| 4,573,406 A | | 3/1986 | Cleemput et al. | 101/127.1 |
| 4,736,224 A | * | 4/1988 | Watanabe et al. | 355/41 |
| 5,241,187 A | | 8/1993 | Ikeda et al. | 250/548 |
| 5,245,922 A | | 9/1993 | Klemm | 101/115 |
| 5,943,089 A | * | 8/1999 | Douglas | 348/87 |

(Continued)

FOREIGN PATENT DOCUMENTS

DE 40 37 678 A1 6/1992

(Continued)

OTHER PUBLICATIONS

International Search Report in PCT/EP03/05200 dated Apr. 28, 2004.

*Primary Examiner*—Anthony H. Nguyen
(74) *Attorney, Agent, or Firm*—Marshall, Gerstein & Borun LLP

(57) ABSTRACT

The disclosure relates to a device and a method for positioning a substrate to be printed in accordance with a screen printing method, lying on a print table, with respect to a template of a screen of the screen printing device. After placement and fixing of the substrate on the print table, and with the screen arranged close to the print position, the side of the screen towards the print table is illuminated from the print table and at least one predetermined edge section of the substrate is photoelectrically detected from the print table. After evaluation of the detection signals, the screen is adjusted into its desired disposition with respect to the actual disposition of the substrate, and then the printing is effected.

16 Claims, 2 Drawing Sheets

U.S. PATENT DOCUMENTS

| | | | | |
|---|---|---|---|---|
| 6,170,394 | B1 * | 1/2001 | Kinoshita | 101/129 |
| 6,363,846 | B1 * | 4/2002 | Murakami | 101/126 |
| 6,512,600 | B1 * | 1/2003 | Kawai et al. | 358/475 |
| 6,729,746 | B2 * | 5/2004 | Suehiro et al. | 362/241 |
| 6,828,170 | B2 * | 12/2004 | Roberts et al. | 438/27 |
| 6,902,309 | B2 * | 6/2005 | Uemura et al. | 362/555 |

FOREIGN PATENT DOCUMENTS

| | | |
|---|---|---|
| DE | 42 33 455 A1 | 4/1993 |
| EP | 574 459 B1 | 12/1993 |
| JP | 57-25960 | 2/1982 |
| WO | WO 99/20404 | 4/1999 |

* cited by examiner

DEVICE AND METHOD FOR POSITIONING A SUBSTRATE TO BE PRINTED

This is the U.S. national phase of International Application No. PCT/EP03/05200 filed May 16, 2003, the entire disclosure of which is incorporated herein by reference.

BACKGROUND OF THE DISCLOSURE

1. Field of the Disclosure

The disclosure relates to a device and method for positioning a substrate, lying on a print table and to be printed in accordance to a screen printing method, with respect to a print template of a screen printing device.

2. Related Technology

The screen printing method belongs to the classical print-through methods by means of which very exact and also fine print patterns can be attained. Such patterns are necessary, for example, for the conductor arrangement in the case of solar cells. Thus, in practice, these are applied with the screen printing method. In order to attain the desired exactly positioned printing of the conductors on the substrate, a very exact positioning is necessary, which should not exceed a positional deviation of ±15 μm. Beyond this, high productivity should also be attainable; that is, short cycle times with as far as possible automatic operation.

Conventionally, the delivered substrate to be printed is placed on the print table of the screen printing device and fixed by means of a vacuum device through suction. The screen carrying the print template or the print pattern is then placed above the print table and lowered on to the substrate for carrying out the screen printing. Due to various circumstances, in particular through the inexactitude of the transport and placing device, upon fixing of the substrate there arise, however, deviations of the relative disposition between screen and substrate to be printed which exceed the necessary accuracy. It is thus necessary to detect the corresponding deviation and in dependence upon the detected deviation correspondingly to alter the relative disposition of substrate and screen. Expediently, this is achieved in general by means of rotating and/or displacing the screen with respect to the substrate already fixed on the print table. The print table may also be displaced and rotated. Finally, a mixed form can also be employed.

Thus, of significance is a very exact determination of the actual disposition of the substrate on the print table. Since the form of the substrate, as it leaves its production process, is very exactly known, it is sufficient to exactly detect certain predetermined edge sections of the substrate in their disposition with respect to the print table, whereby such an edge section is characterized by a rim; that is, an abrupt transition from substrate to print table.

A screen printing machine of the known kind is disclosed in DE 40 37 678 A1. With this device a material web to be printed is guided to the screen printing device by means of a known web guide and transport device, which screen printing device includes at least one displaceably mounted screen and a device for the reading of alignment marks or the like for multi-colour printing. The displaceably mounted screen is connected with servomotors which are controlled by at least one monitor camera reading the alignment marks or colour displacements, wherein the pulse generator thereof controls the servomotors via a computer or the like.

Disadvantageous with this device is that the displacement of the screen is effected corresponding to the relative disposition of two or more colour print layers lying upon one another, through which a correction of the screen position is possible only after printing has taken place. This is due to the fact that the material to be printed is of a continuous material web, as a result of which no positioning of the screen with regard to a fixed point on the material to be printed itself can be effected.

In accordance with DE 692 30 099 T2 a substrate to be printed is fixed on a print table. Both the substrate and also the screen to be employed possess reference marks. Above the print table an observation device is so mounted that it can view the print table, in particular the reference marks on the substrate mounted on the print table, and can store the position of the reference marks. If the screen or the template is now moved over the substrate to be printed, the observation unite can thus correspondingly determine the position of the reference marks of the screen and from this the relative disposition of the screen with respect to the substrate on the print table. By means of an appropriate correction of the position of the screen, the reference marks of substrate and screen can thus be brought into register.

Disadvantageous here is that for reading the reference marks of the substrate the screen must in each case be removed from the region viewable by means of the observation unit. This signifies a reduction of the speed of the production process.

Conventionally, the substrate and the surrounding region of the print table are well illuminated and the actual disposition of the substrate or the actual disposition of the predetermined edge sections of the substrate is detected by means of a photoelectric detector such as in particular a CCD camera. The electrical signal characterizing the actual disposition of the edge section is processed, and by means of signals generated in the processing the relative adjustment of the screen with respect to the substrate fixed on the print table can be achieved.

With a commercially available positioning system in the solar cell field, by means of a moveable CCD camera, the disposition of the substrate placed on the print table and fixed is achieved outside the actual print region by means of successive travel to the predetermined edge sections. After detection of the various edge sections the disposition is calculated by coordinate calculation. Together with the calculation and the subsequent adjustment of the screen, the print table is moved into the print position. This manner of proceeding is very time consuming and requires numerous moveable parts. Beyond this, considerable masses must be moved. Further, a very complex calibration is necessary, in particular through the carrying out of test prints. If two moveable print tables are employed, on which printing takes place intermittently, different print results can arise.

To overcome certain problems with the known positioning system, in a further development the CCD camera is also used for detecting the disposition of the screen, so that the positioning of the screen with respect to the substrate is somewhat simplified, in particular the initialization or calibration is simplified. However, the cycle times are even greater and the device overall more complex and contains even more moveable parts.

With a further conventional manner of proceeding with two print tables, which are horizontally moveable, there are provided in each case cameras associated with each predetermined edge section for detecting the actual disposition of the substrate. In general, three camera positions are sufficient, but the above-mentioned coordination problems arise to a greater degree, through which different print results arise, whereby also the mentioned disadvantages of the numerous parts to be moved also emerge.

SUMMARY OF THE DISCLOSURE

The disclosure thus makes available a device and a method for positioning a substrate placed on a print table, with which for position control of the relative disposition of the substrate on the print table with respect to the screen there is necessary a displacement of the screen which is as small as possible, through which the process is simplified and accelerated.

According to the disclosure both an illumination arrangement and a photoelectric detector are arranged in or under the print table and to make use of the vary closely approached screen as a diffuse reflector, through which the print table can remain fixed in place and the screen is only to be adjusted to a slight extent in dependence upon the values for the actual disposition determined by the detection.

The disclosure will be described in more detail with reference to the exemplary embodiment illustrated in the drawings. There is shown:

DETAILED DESCRIPTION

Figure 1:
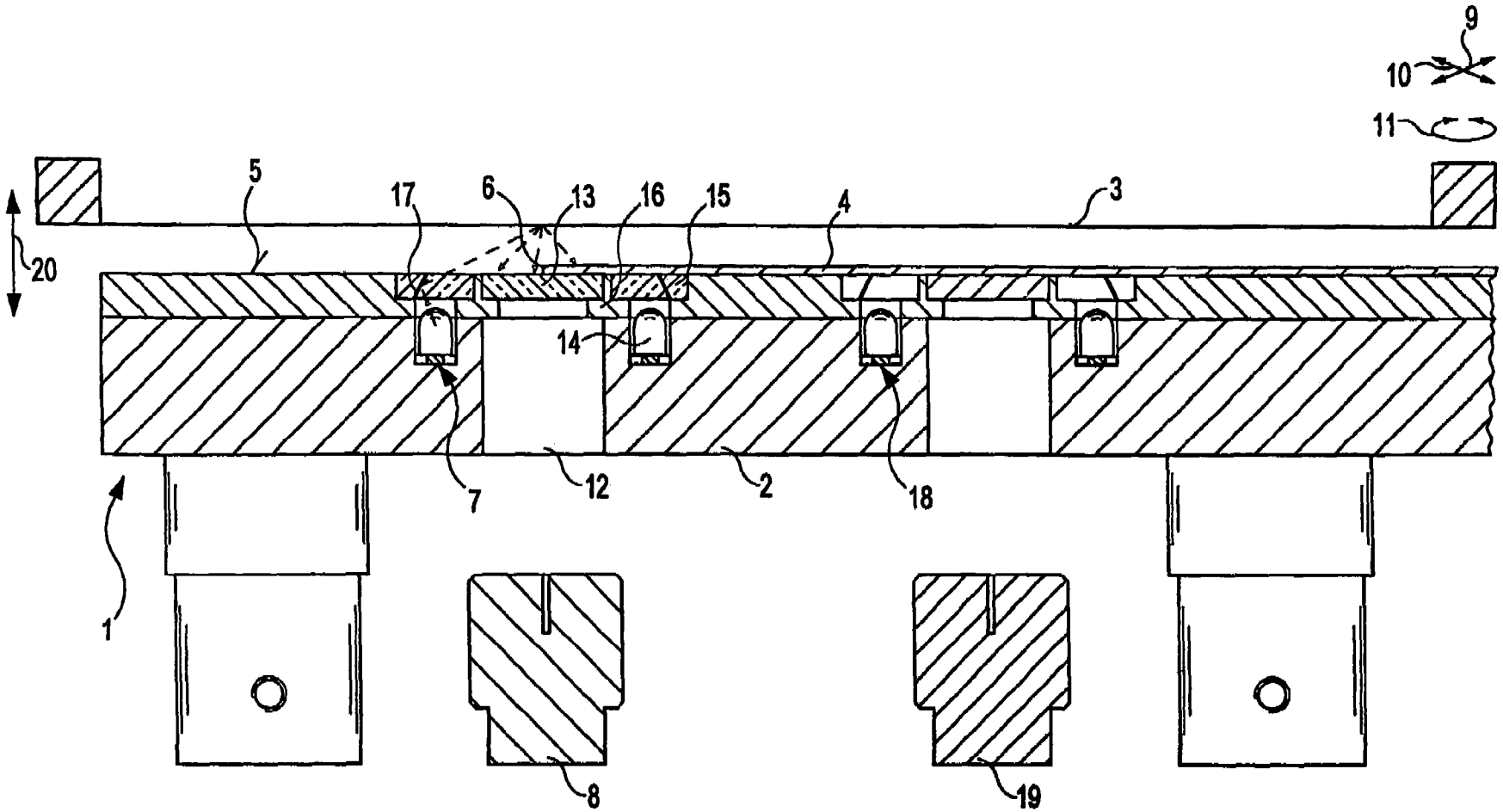
FIG. 1 is a schematic depiction of one embodiment of a screen printing device.
Figure 2:
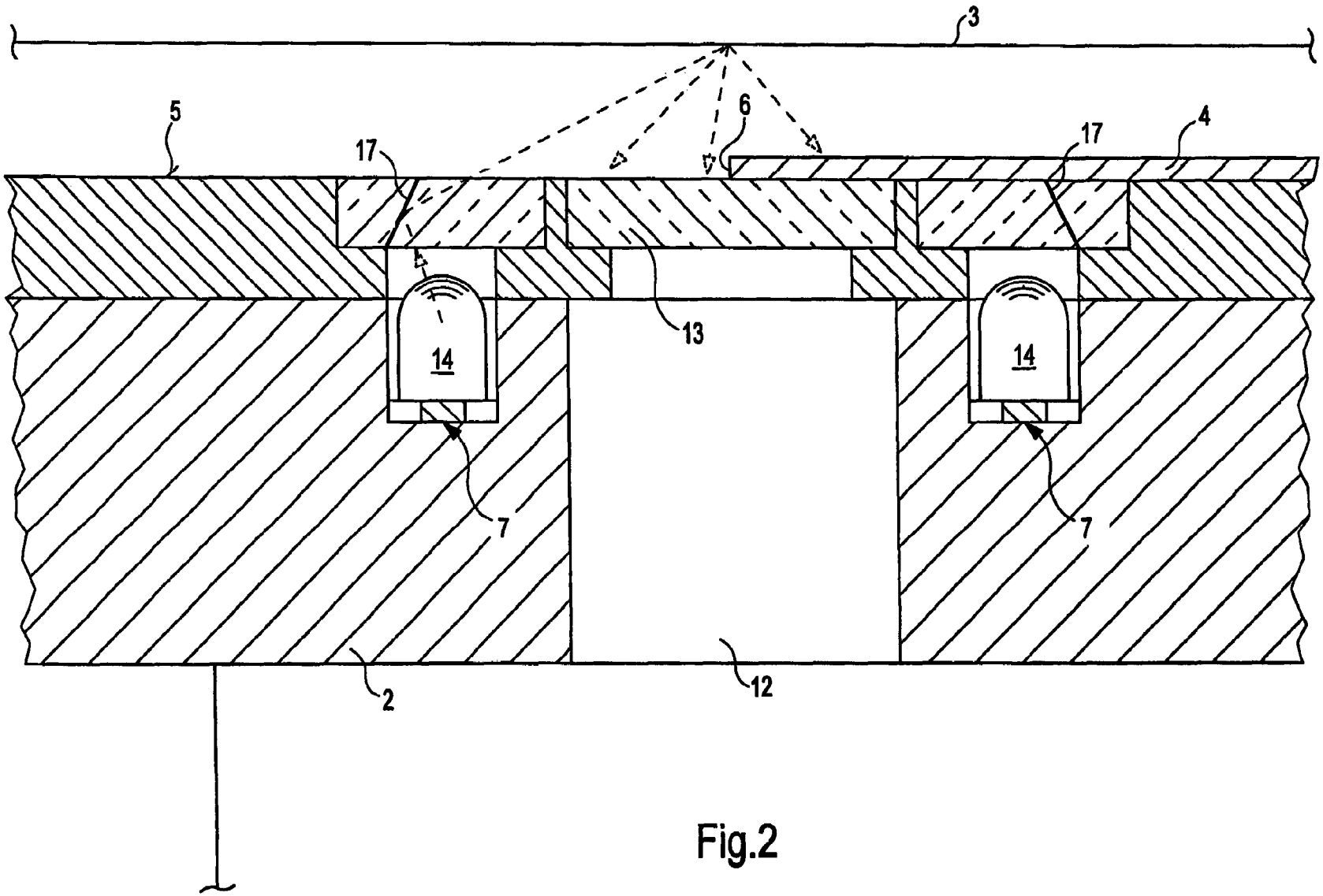
FIG. 2 is a detailed view of the embodiment of FIG. 1.

FIG. 1 shows a screen print device 1, including a print table 2 and a screen 3.

By means of a non-illustrated arrangement, which may be a belt transport device, a substrate 4 to be printed is placed in a disposition on the table surface 5 of the print table 2 corresponding as closely as possible to the print disposition and fixed in the disposition by means of vacuum suction devices not illustrated in detail and per se known. The actual or current disposition of the placed substrate 4 is exactly detected at certain predetermined edge sections 6. In general three such edge sections are sufficient; in individual cases, however, more or less edges sections may be necessary or sufficient, dependent upon the kind of the substrate and the exactitude of the print to be applied.

There is provided on the one hand an illumination arrangement 7 which from the print table 2 side illuminates the oppositely lying side of the screen 3, and this in the region of the observed predetermined edge section 6, whereby the light is diffusely scattered at the screen 3. Through this, there is achieved a very good illumination of the substrate 4 in the predetermined edge section 6, and this with high contrast.

By means of a photoelectric arrangement, in particular a CCD camera 8, associated with each of the predetermined edge sections 6, this strong contrast is detected; that is, the actual disposition of the predetermined edge section 6 with respect to the print table 2 is detected extremely accurately. Alternatively, the photoelectric arrangement may be constituted by means of a suitable laser device or a line scan camera. This exact detection allows the derivation of adjustment signals for adjusting the screen 3 with respect to the substrate 4 on the print table 2 corresponding to adjustment movements of the screen 3 illustrated by means of arrows 9, 10 and 11, by means of displacement in the horizontal plane and rotation in this horizontal plane. The adjustment arrangements necessary for this are not illustrated in detail, since they are commercially available. Also the evaluation circuit for the detection signals of the CCD camera 8 is not illustrated, since this also is commercially available.

The CCD camera 8 thereby observes the predetermined edge section 6 through the print table 2 by means of a viewing window 12 which in the region of the table surface 5 is closed off by means of a transparent insert, for example an acrylic or glass insert 13 the side of which insert towards the screen 3 is flush with the table surface 5.

The illumination arrangement 7 is likewise associated with the respective predetermined edge section 6 and in the case of the exemplary embodiment integrated into the print table 2 in this region. In particular there is installed in the print table 2 at least one light emitting element such as an LED 14 and illuminates the facing side of the screen likewise through a transparent insert, for example an acrylic or glass insert 15, whereby the side thereof towards the screen 3 is likewise flush with the table surface 5 of the print table 2. In the case of the exemplary embodiment there are provided two such LEDs 14 with corresponding glass inserts 15. The electrical supply lines are not illustrated. There may be provided more than two such LEDs 14, whereby these are arranged in substance concentrically with respect to the viewing window 12.

It is thereby expedient to separate the glass insert 13 of the viewing window 12 of the CCD camera 8 and the glass insert 15 of each LED 14 by means of a light impermeable web 16. Through this it is ensured that no scattered light from the LED 14 and its insert 15 can reach the viewing window 12 and the glass insert 13 and thus reach the CCD camera 8, but only light scattered from the screen 3. Beyond this it is found that possible impressions, markings or the like on the surface on the substrate 4, which lies directly on the table surface 5 of the print table 2, are so contrast-poor relative to the substrate 4 itself that they cannot be detected by the CCD camera 8. Also, reflections, such as can arise in particular with multicrystalline materials, are likewise largely if not completely faded out or suppressed. The CCD camera 8 thus detects exclusively and only the predetermined edge section 6.

Advantageously there is placed in the glass insert 15 for the LED 14 a reflector or mirror 17, in such a position that the light emitted from the LED 14 is directed or focused substantially on one region of the screen 3 which corresponds approximately of the middle of the detection part of the CCD camera 8, as approximately the axis of symmetry of the viewing window 12. Through this, the accuracy of the detection of the respective edge section 6 is increased. Beyond this, a disruption or hindering of the detection in the case of another predetermined edge section can also be reliably avoided if this is, spatially considered, very near. Alternatively to the mirror 17 the light can also be formed by means of another suitable device, such as e.g. a light conductor, also the screen 3.

Along with the described arrangement of illumination arrangement 7 and CCD camera 8, FIG. 1 shows a further corresponding arrangement of a second illumination arrangement 18 and second CCD camera 19 whereby these two arrangements have in substance the same structure and the same association with one another. This second arrangement of illumination arrangement 18 and CCD camera 19 serves for the detection of a further predetermined edge section, not here illustrated. This further edge section may relate to the same substrate 4.

In order to make the screen printing device suitable and rapidly settable also for the printing of substrates of other formats, the second illumination arrangement 18 and the second CCD camera 19 may be located in a disposition which corresponds to a predetermined edge section of a substrate of a different format. Thereby, the LED of this second illumination arrangement 18 can be provided already integrally built into the print table 2, whereby it is only put into operation when a corresponding associated or predetermined edge section is to be detected. On the other hand, the CCD camera 19 can also be removed in suitable cases. Finally, a CCD camera may also be associated with a plurality of viewing windows and be moveable between them, if appropriate also automatically, depending on the format of the substrate to be printed.

Of advantage in the case of the device according to the disclosure is further that after the detection of the predetermined edge section 6 neither the print table 2 nor the substrate 4 are moved, through which the highest possible accuracy is ensured in detection and in printing. Since, after the adjustment of the screen 3 as a result of the detection of the disposition of the at least one predetermined edge section 6 of the substrate 4 to be printed, there is needed now only lowering over a very short path (corresponding to arrow 20) on to the substrate 4, for carrying out to the screen printing, there is also attained here the highest possible accuracy, since any influence which could arise in the case of larger movement paths is avoided.

It is found in particular that the spacing of the screen 3 with respect to the table surface 5 is determined only through the thickness of the substrate 4 and the conditions that are necessary in order to deliver the substrate 4 from outside the print table 2 to this table and place it on the table surface 5. This allows the disposition of the substrate 4 and of the screen 3 to be brought, in an automatic operating procedure, already at an early as possible stage into preliminary or coarse register, and to bring about the final adjustment solely for the alignment of the screen 3 with respect of the substrate 4 as a result of the signals of the CCD camera 8. Also the calibration of the system can be carried out without additional means.

Since solar cells typically have a thickness of about 0.3 mm and the spacing (jump) between screen and the product to be printed in the screen printing process is about up to 1 mm–1.5 mm (typically), the screen printing device is very tolerant in the event of variations of thickness, in particular when the spacing between the screen 3 and the table surface 5 upon the carrying through of the photoelectric detection is about 5 mm.

It is found that since only one printer table 2 is employed and this is not moved, a very simple comprehensible structure is possible whereby consistent print results are attained. An adaptation to other configurations, i.e. print patterns, can likewise be carried out without problem.

In particular it has been found that the printing of solar cells by the screen printing device can be carried out with cycle times of only three seconds or less per printing procedure.

Of course the disclosure is not restricted to the printing of solar cells. The disclosure is also suitable for printing of thick film hybrids, LCD arrangements, in particular flat screens, LTCCs, and the like.

The invention claimed is:

1. A screen printing device comprising:

a print table for disposing a substrate thereon;

a photoelectric element to detect an actual disposition of the substrate on the print table and which generates adjustment signals;

a screen; and an illumination element which illuminates a first side of the screen;

wherein the screen is adjustable with respect to the print table and the substrate in response to the adjustment signals, the photoelectric element detects light diffusely reflected from the first side of the screen and evaluates the diffusely reflected light with regard to the actual disposition of an edge of the substrate and derives therefrom the adjustment signals and the screen is adjusted based on the adjustment signals, and the edge of the substrate is indirectly illuminated by the light diffused by the first side of the screen.

2. The screen printing device of claim 1, wherein the substrate is transported to the print table and placed on the print table.

3. The screen printing device of claim 1, wherein the illumination element is a light emitting diode (LED).

4. The screen printing device of claim 1, wherein the photoelectric element is a CCD imaging apparatus.

5. The screen printing device of claim 1, wherein the screen is moved in a plane parallel to the substrate.

6. The screen printing device of claim 1, wherein the screen is moved by rotation in a plane parallel to the substrate.

7. The screen printing device of claim 1, wherein the print table includes a first light permeable portion in a region of the illumination element and a second light permeable portion in the region of the photoelectric element, the illumination element and the photoelectric element being disposed in or below the print table.

8. The screen printing device of claim 7, wherein one of the first and second light permeable sections of the print table comprises acrylic glass.

9. The screen printing device of claim 8, wherein the acrylic glass comprises an insert.

10. The screen printing device of claim 7, wherein the first light permeable portion and the second light permeable portion are separated from each other.

11. The screen printing device of claim 7, wherein the first light permeable portion substantially concentrically surrounds the second light permeable portion.

12. The screen printing device of claim 7, wherein the first light permeable portion includes a mirror which deflects emitted light onto a region of the screen lying opposite the associated photoelectric element.

13. A method of positioning a substrate on a print table with respect to a print template screen comprising the steps of:

placing and fixing the substrate on the print table;

positioning the print template screen at a first distance from the substrate;

lowering the print template screen to a second, closer distance from the substrate;

illuminating a first side of the print template screen which is facing the print table;

detecting the actual disposition of a predetermined edge section of the substrate with a photoelectric element which receives diffusely reflected light from the first side of the print template screen in the region of the predetermined edge of the substrate;

adjusting the position of the screen with respect to the substrate and with regard to the desired position; and bringing the print template screen into contact with the substrate for printing.

14. The method of claim 13, further including the step of determining the relative disposition of the substrate on the print table with respect to the print template screen at three predetermined edge sections of the substrate.

15. The method of claim 13, further including the step of adjusting the print template screen with respect to the substrate while maintaining a slight spacing between the print template screen and the substrate and after the substrate is correctly positioned with respect to the print template screen, bringing the print template screen into a printing disposition for printing of the substrate.

16. The method of claim 13, wherein the screen is adjusted before the screen is positioned on the substrate for printing.

* * * * *